US005268879A

United States Patent [19]

Flanagan

[11] Patent Number: 5,268,879

[45] Date of Patent: Dec. 7, 1993

[54] ELECTRO-ACOSTIC TRANSDUCERS

[75] Inventor: Peter F. Flanagan, Cranston, R.I.

[73] Assignee: Raytheon Company, Lexington, Mass.

[21] Appl. No.: 804,344

[22] Filed: Dec. 3, 1991

[51] Int. Cl.[5] ..... H04R 23/00

[52] U.S. Cl. ..... 367/141; 367/185; 367/174; 367/175; 181/110

[58] Field of Search ..... 367/140, 141, 185, 174, 367/175; 181/110, 113, 106

[56] References Cited

U.S. PATENT DOCUMENTS

| | | | |
|---|---|---|---|
| 3,225,326 | 12/1965 | Massa | 367/175 |
| 3,308,423 | 3/1967 | Massa | 367/175 |
| 4,208,736 | 6/1980 | Babikyan | 367/153 |
| 4,517,514 | 5/1985 | Howell | 367/185 |
| 4,651,044 | 3/1987 | Kompanek | 310/323 |
| 5,126,979 | 6/1992 | Rowe, Jr. et al. | 367/175 |

*Primary Examiner*—J. Woodrow Eldred

*Attorney, Agent, or Firm*—Donald F. Mofford; Richard M. Sharkansky

[57] ABSTRACT

A flexural transducer includes a hollow tube that is magnetically driven by a coil/magnet assembly. A magnetic field is provided by passing a current through the coil. The filed passes through an air gap between the coil and the magnet to attract and repel the magnet during alternating portions of the current's cycle. The magnetic transducer driver mechanism permits high drive capability, high temperature operation and provides lower frequency operation than conventional ceramic drivers.

17 Claims, 4 Drawing Sheets

ELECTRO-ACOSTIC TRANSDUCERS

BACKGROUND OF THE INVENTION

The invention relates generally to electro-acoustic transducers and more particularly to transducers having variable reluctance electromechanical driver elements.

As is known in the art, a transducer is a device that converts energy from one form to another. In underwater acoustic systems, transducers generally are used to provide an electrical output signal in response to an acoustic input which has propagated through a body of water, or an acoustic output into the body of water in response to an input electrical signal.

A transducer intended primarily for the generation of an acoustic output signal in response to an electrical signal is generally referred to as a projector. Conversely, a transducer designed for producing an electrical output in response to an acoustic input is called a hydrophone. Both hydrophone and projector transducers are widely employed in sonar systems used for submarine and surface ship applications.

Transducers generally include a mechanical member such as a piston, shell, or cylinder and a driver. In applications where the transducer is used as a projector, the driver is responsive to electrical energy and converts such energy into mechanical energy to drive the mechanically driven member. The driven member converts the mechanical energy into acoustic wave which propagate in the bottom of water. Most acoustic transducers have driver elements which use materials having either magnetostrictive or piezoelectric properties. Magnetostrictive materials change dimension in the presence of an applied magnetic field, whereas piezoelectric materials undergo mechanical deformation in the presence of an electrical field.

Common configurations for acoustic transducers include hoop-mode, split-ring cylindrical , flextensional, and tonpilz transducers which can all accommodate either piezoelectric or magnetostrictive drivers.

As is known by those of ordinary skill in the art, the ceramic elements of a piezoelectric driver are susceptible to failure when tensional stresses are applied to the elements. To avoid such failure, it is generally necessary to compressively prestress the piezoelectric elements of the driver. The magnitude of prestress is generally related to the magnitude of the tensile stresses induced in the elements as an electrical signal is applied to the driver. The initial prestress compensates for the induced tensile stresses to prevent the elements from being placed in tension during operation of the driver.

Piezoelectric ceramic drivers used in hoop-mode and split ring cylindrical transducers are generally disposed along the inner surface of a hollow cylindrical shell. The ceramic drivers generally have electrodes disposed on the inner and outer surfaces of the ceramic elements and are polarized in a manner such that when an alternating current is applied across the electrodes, the driver causes the hollow shell to expand and contract in the radial direction. Accordingly, both the hoop-mode and split-ring cylindrical transducers are said to operate in the radial mode.

In a flextensional transducer an electromechanical driver is disposed within an elliptical shell. Piezoelectric ceramic drivers used for flextensional transducers generally comprise a stack of ceramic elements disposed within and along the major axis of the elliptical shell. Prestress is applied to the driver by compressing the shell along its minor axis, thereby extending the major axis dimension for allowing a slightly oversized ceramic stack driver to be placed along the major axis. Releasing the compressive force applied to the elliptical shell places the driver in compression.

Flextensional transducers using piezoelectric ceramic drivers are generally not desirable for use in hostile environments, such as in wartime, where underwater explosions can occur. During an underwater explosion, travelling shock waves with very high hydrodynamic pressure levels are generated. These pressure levels are of such magnitude that the ceramic driver being under high compression and mounted along the major axis of the elliptical shell, would be subjected to a high self-inertial loads and would begin to bend. Although, piezoelectric ceramic materials can typically withstand very high compressive forces, these ceramics can easily fracture when subjected to tensile forces as mentioned above.

The longitudinally polarized cylindrical projector, known commonly as the tonpilz projector includes, an electromechanical driver mounted between a stationary base plate, called the tail mass, and a moveable solid metal piece with a flat circular, or piston-like, face called the head mass. A metal rod through the center of the driver connects the tail mass to the head mass. When a piezoelectric driver is used in a tonpilz projector, the cylindrical ceramic elements are mounted between the tail mass and head mass and the metal rod is disposed through the center of the ceramic stack of elements. A locking nut is generally secured to the metal rod and tightened in order to provide the necessary prestress to the ceramic elements.

Although most tonpilz projectors include piezoelectric or magnetostrictive drivers, these projectors may also utilize moving armature (variable reluctance) drivers. A variable reluctance tonpilz transducer generally include two end plates separated by a center plate and a pair of electromagnet assemblies disposed between the center plate and each of the top and bottom plates. A pair of sidewalls are mounted to the two end plates to provide a box-like housing. Each electromagnet assembly has a pair of opposing pole pieces fabricated from a highly permeable material with a first one of the pole pieces, from each of the electromagnet assemblies, having a coil wound around the pole piece to provide a solenoid. Each of the first one of the pole pieces are disposed on respective inner surfaces of the top and bottom end plates of the projector. Second pole pieces, from each of the electromagnetic assemblies are disposed on opposite sides of the center plate and oppose corresponding first pole pieces of the respective electromagnetic assemblies. In addition, a plurality of spring sections, each consisting of furnace brazed steel rings, are mounted between the center piece and each of the end plates for establishing the mechanical resonance of the transducer.

In operation, a dc polarizing current is applied to the coils of each of the electromagnet assemblies such that a magnetic force of attraction is provided across the respective gaps of the assemblies. An alternating current is superimposed over the depolarizing current such that during a first half cycle, the pole pieces of a first one of the electromagnets are attracted to each other and the pole pieces of a second one of the electromagnets are repelled from each other. Conversely, during a second half cycle, the polarity of the magnetic fields between the pole pieces of the respective electromagnet assemblies are reversed. This push/pull action causes the end plates and sidewalls to vibrate as a "lumped mass", in a piston like manner and in opposite phase to the center plate. Maximum vibration occurs when the alternating current is adjusted in frequency to the mechanical resonance of the lumped mass of the assembly.

The simplicity of the design of the tonpilz projector makes it one of the more popular projector configurations in use today. However, because the size of acoustic transducers in general is inversely proportional to their operating frequency, tonpilz projectors are generally large and heavy, particularly at low acoustic frequencies. Further, the tonpilz projector has a relatively low efficiency in converting electrical energy to acoustic energy compared with other projector configurations.

Piezoelectric drivers are relatively inexpensive as compared to magnetostrictive drivers due to the relative low cost of the piezoelectric material and the relative ease of assembly. However, as mentioned earlier, transducers using piezoelectric or magnetostrictive drivers have the disadvantage of requiring the application of mechanical bias or prestress to their elements. Further, piezoelectric ceramic drivers generally lose their piezoelectric characteristics through depolarization at temperatures above approximately 180° F. For this reason, transducers having piezoelectric drivers are limited generally to underwater sonar applications and are not useful in high temperature environments, such as in oil exploration applications. In such applications, transducers are lowered into holes drilled several thousand feet into the earth, where the temperature may be several hundred degrees. Signal response characterization of the transducer output provides data for determining the material composition of the drilling area.

Electromechanical drivers using magnetic materials which change dimension when disposed within a magnetic field are known as magnetostrictive drivers. Magnetostrictive drivers using such magnetic materials, when placed in a magnetic field, contract along the field direction and expand in the transverse direction. The magnetostrictive driver typically has a plurality of laminated magnetostrictive elements having a conductor disposed about the elements in a helical pattern for providing the magnetic field to the driver. One type of material having magnetostrictive characteristics used in acoustic transducers is polycrystalline nickel. Nickel-based materials are relatively sturdy and strong, and for this reason, drivers using polycrystalline nickel are used for applications where the transducers may be subjected to high levels of shock. However, nickel-based magnetostrictive drivers have a relatively low efficiency in converting applied electrical power to acoustic power, as compared with piezoelectric drivers. More recently, newer materials, such as lanthanide-based alloys have been used. These materials provide increased acoustic power as compared to nickel based drivers. However, lanthanide-based alloys are relatively expensive when compared with polycrystalline nickel and piezoelectric ceramic and further, as is the case with piezoelectric materials, lanthanide alloys are also sensitive to tensile stresses and easily fracture when subjected to such forces.

Accordingly, a wide variety of acoustic transducers having electromechanical drivers, generally use drivers either of the piezoelectric or magnetostrictive type. While piezoelectric ceramic drivers are relatively inexpensive as compared to most magnetostrictive drivers, the need for a mechanical bias to protect the driver elements increases the complexity of the design and adds to the cost of the transducer. On the other hand, nickel-based magnetostrictive drivers, while suitable for use in hostile environments, are relatively inefficient in generating acoustic power and accordingly have a relatively low drive capability. Further, lanthanide based magnetostrictive drivers while being more efficient than nickel based driven are nevertheless high in cost and are easily damaged when subjected to high stress conditions.

Accordingly, there is a need for an electromechanical driver to be used in a transducer for providing high acoustic drive capability in hostile or rugged environments at a relative low cost.

SUMMARY OF THE INVENTION

In accordance with the present invention, the transducer includes a hollow shell having an inner surface and an electromagnet disposed within the hollow shell. The electromagnet is disposed adjacent first portion of the inner surface of the hollow shell and has a pair of end portions corresponding to pole pieces of the electromagnet. The transducer further includes means, disposed within the hollow shell, for providing a magnet, said means having first and second end portions corresponding to first and second pole pieces of the magnet means. At least one of the first and second pole pieces of the electromagnet is disposed opposing a corresponding one of the first and second pole pieces of the magnet means. With such an arrangement, a flexural transducer is provided having an electromagnet and a means for providing a magnet disposed within a hollow shell, each disposed along respective inner portions of the hollow shell such that at least one pole piece of the electromagnet is disposed opposite at least one pole piece of the magnet means. The opposing pole pieces of the electromagnet are spaced by a gap. The electromagnet, being responsive to an alternating current, provides during a first half cycle, a first magnet polarity at least one pole piece with such polarity being the same as the magnetic polarity of the opposing pole piece of the magnet means. During this first half cycle the electromagnet and magnet means are repelled thus forcing portions of the hollow shell to expand outward. During a second half cycle, the magnetic polarity of the at least one pole piece of the electromagnet is reversed and thus is attracted to the at least one pole piece of the magnet means causing the portions of the hollow shell to contract inward. A flexural transducer having such an electromechanical driver may be said to operate in a variable reluctance mode. Transducers having variable reluctance drivers are rugged and may be used in hostile environments where high levels of hydrodynamic acceleration would otherwise render the transducer inoperable. Further, the variable reluctance driver may be attractive for use in applications requiring high temperature operation such as oil well logging and oil exploration. These drivers provide high acoustic output power and are relatively inexpensive when compared with piezoelectric and magnetostrictive drivers of comparable size and operating frequency.

BRIEF DESCRIPTION OF THE DRAWINGS

The foregoing features of this invention as well as the invention itself may be more fully understood from the following detailed description of the drawings in which.

DESCRIPTION OF THE PREFERRED EMBODIMENTS

Figure 1:
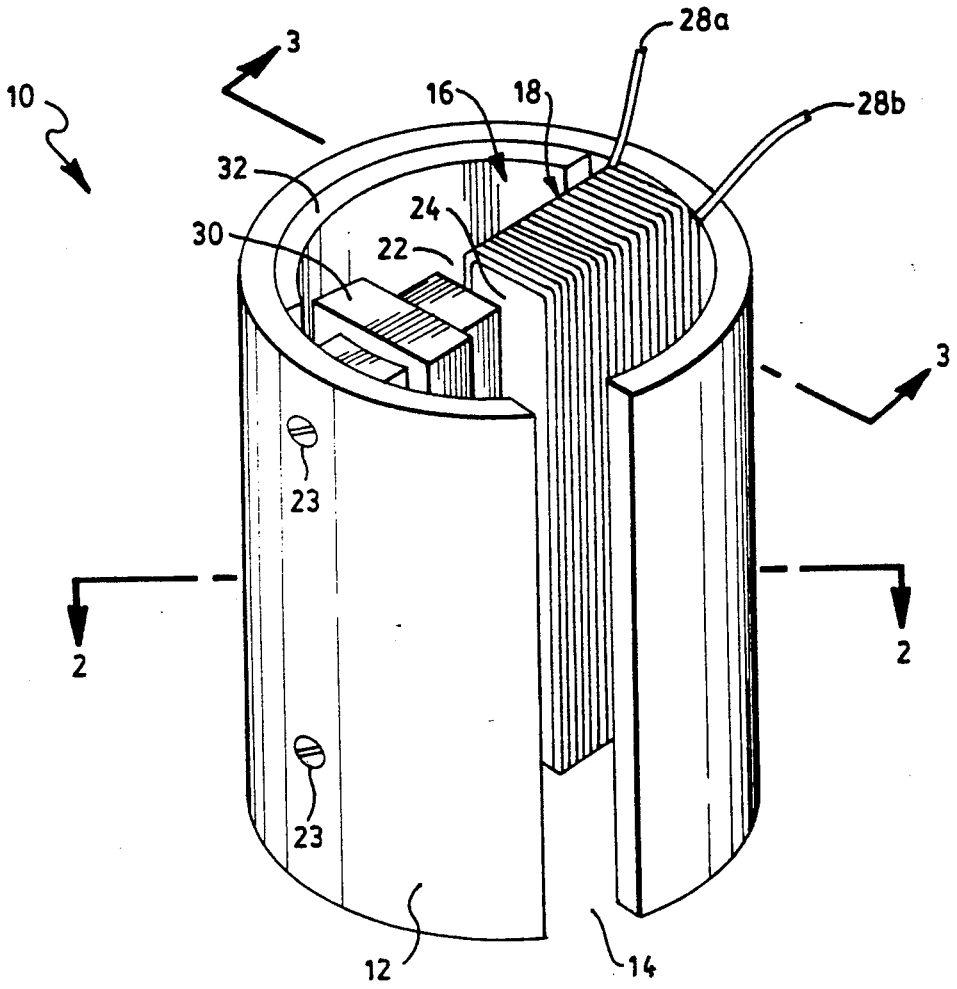
FIG. 1 is a somewhat diagrammatical, isometric view of a split-ring cylindrical transducer having a magnetically driven electromechanical driver.
Figure 2:
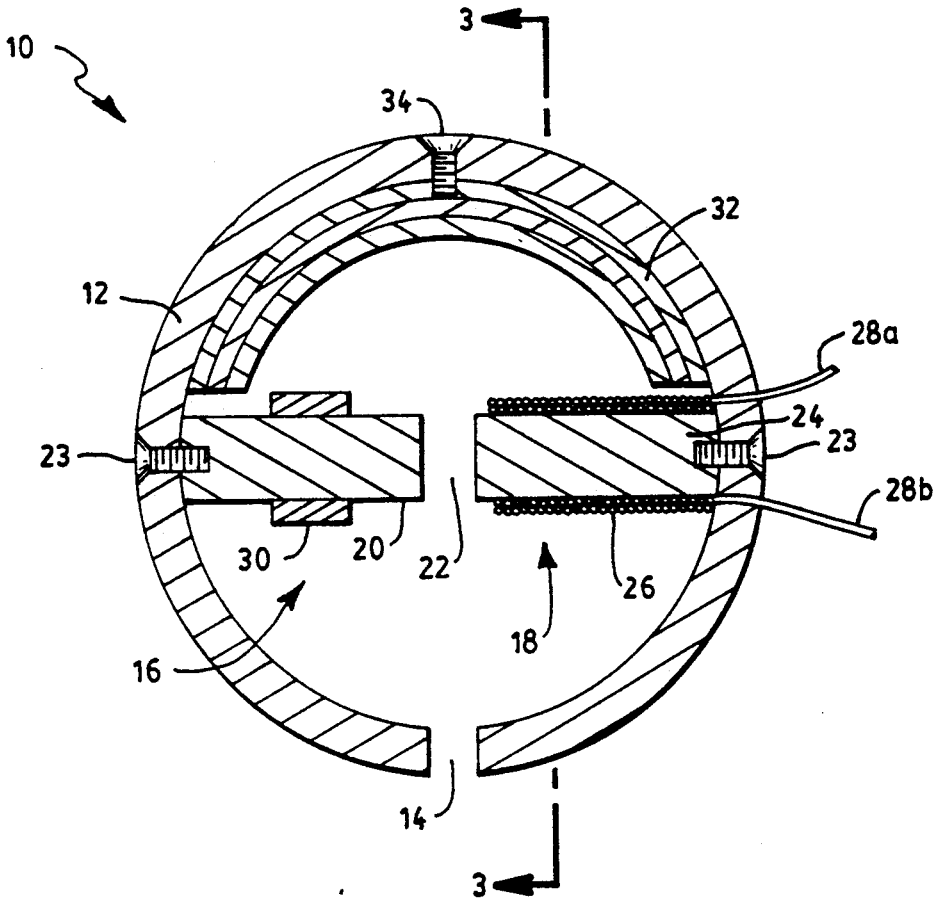
FIG. 2 is a cross-sectional view of the split-ring cylindrical transducer taken along lines 2—2 of FIG. 1.
Figure 3:
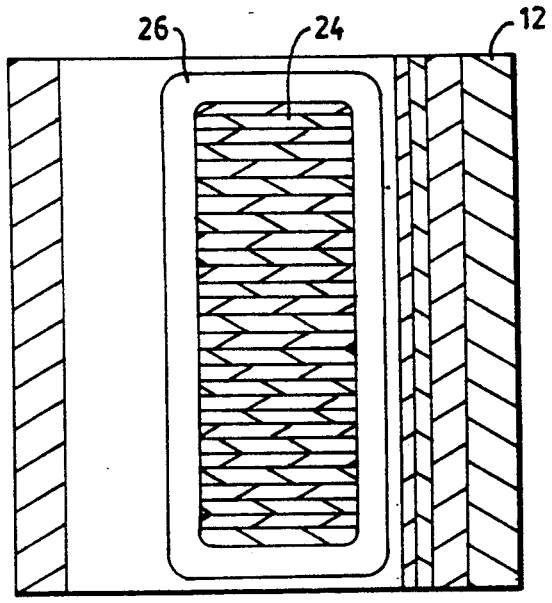
FIG. 3 is a cross-sectional view of a portion of the split-ring cylindrical transducer taken along lines 3—3 of FIG. 1.

Referring now to FIGS. 1-3, a split-ring cylindrical transducer 10 is shown to include a hollow tube 12 having a gap 14 along the length of the tube 12 and an electromechanical drive 16 disposed therein.

The electromechanical driver 16 includes an electromagnet assembly 18 having a first end disposed along a first portion of an inner wall portion of the tube 12. The driver 16 further includes a permanent magnet 20 disposed along a second portion of the inner wall portion of the tube at a location opposite the electromagnet assembly 18. The element has a gap 22 provided between opposing ends of the electromagnet assembly 18 and permanent magnet 20. The electromagnet assembly 18 and permanent magnet 20 of the driver 16 are here, aligned within the tube such that the gap 22 between the assemblies is generally aligned with the gap 14 of the tube. As shown in FIG.2, the electromagnet assembly 18 and permanent magnet 20 of the driver 16 are attached to respective inner wall portions of the tube 12 using a plurality of threaded screws 23 (FIG. 2) disposed through the tube 12 of the transducer 10. The transducer further includes a curved member 32 disposed within and conforming to a third inner portion of the hollow shell between the first and second inner portions and opposite the gap 14 of the tube. The curved member 32 is shown here, to include a plurality of highly permeable material layers, such as iron laminated together with an epoxy adhesive. The curved member 32 provides a return path for magnetic flux of the field generated by both the electromagnet assembly 18 and the permanent magnet 20. The high permeability of the layers provides a significantly greater magnetic field and a significantly more efficient electromechanical driver 16. The curved member 32 is shown here to be secured to the hollow shell with a screw 34. Alternatively, the curved member 32 may be eliminated by incorporating into a single unit the curved member with the tube 12. However, in this embodiment, the tube 12 is required to be fabricated using a highly permeable material. Because such materials are relatively heavy, in applications where it is desirable that the transducer be lightweight, the tube 12 and curved members are fabricated independently.

The electromagnet assembly 18 includes a core 24 and a solenoid 26 having an insulated conductor wound about the core 24 in the form of a helix. The core 24 is shown here, to include a plurality of layers of high silicon transformer steel, an alloy known for its characteristic of high permeability. The layers are laminated together with any adhesive for joining such materials as is known by those of ordinary skill in the art. The electromagnet assembly 18, in response to an electric current applied to the solenoid 26, provides a magnetic field coaxial with the helix. Removing the current from the solenoid will generally demagnetize the assembly and discontinue the magnetic field. The solenoid 26 has terminals 28*a*, 28*b* for allowing the application of electric current from an external power source (not shown).

The permanent magnet 20 is here, fabricated from a highly permeable material alloy of neodymium, iron and boron known as Incor, manufactured by IG Technologies, Inc., 160 Old Derby Street, Hingham, Massachusetts and is shown here having a member 30 attached thereto. The member 30 is provided to the permanent magnet 20 such that the weight of the electromagnet assembly 18 is substantially equal to the combined weight of the permanent magnet 20 and member 30. The member 30 is used to balance the weight of the permanent magnet with that of the electromagnet so that the driver assembly operates with a higher efficiency thereby providing greater acoustic power from the transducer.

In one application, a flexural transducer is used as a sonobuoy, a relatively small sonar set dropped by an aircraft for underwater listening or echo ranging. In such applications, the transducers generally have standard sizes and dimensions for conforming to sonobuoy ejection mechanisms. The hollow shell for a transducer used in these applications has a longitudinal length of 5 inches, an outer diameter of 4.6 inches, and a wall thickness of .425 inches. For a hollow shell having such dimensions, the electromechanical driver is required to provide approximately 450 lbs. of force to the shell. To provide a force of this magnitude, a magnetically driven electromechanical driver in accordance with the present invention would require a magnetic circuit having a field strength of approximately 14,000 gauss. The field strength is dependent on a number of variables, including the core material, size of the curved member, number of turns of the coil, and the spacing between the opposing ends. In general, the force exerted by the driver is inversely proportional to the gap spacing. However, the spacing is limited by not only the physical displacement of the elements but by the magnetic saturation level of the permeable materials and heating at the faces of the magnetic elements. The spacing of the opposing ends of the electromagnet assembly 18 and the permanent magnet 20 is here 0.050 inches. The core of the electromagnetic assembly 18 is here fabricated from a 1.85"×1"×4" block of laminated silicon iron with approximately 100 turns of insulated copper transformer wire wound thereon. The curved member is fabricated from laminated silicon iron and has a thickness of at least 0.5 inches. Each end of the curved member is spaced from respective outer surfaces of the electromagnet assembly and permanent magnet by a 0.010 inch gap to accommodate the required magnetic flux.

In operation, an alternating current having a predetermined frequency is applied to the electromagnet assembly 18 via terminals 28*a*, 28*b* of the solenoid 26. In response to the applied current, a magnetic field is generated in the electromagnet and a portion of the field is provided in the gap 22. Similarly, the permanent magnet has a magnetic field with a portion of its field provided in the gap 22. During the first half of a cycle the second end of the electromagnet assembly 18 is attracted to the permanent magnet 20 and is repulsed during the second half of the cycle such that the hollow tube 12 expands and contracts in the radial direction. Accordingly, the electromechanical split-ring cylindrical projector is said to operate in the radial mode.

The magnetically driven variable reluctance transducers, as described above, will generally operate at lower frequencies and provide greater acoustic power when compared to transducer configurations using ceramic type electromechanical drivers of comparable size and geometry. Further, ceramic driven transducers, as mentioned earlier, generally require a mechanical bias or "prestress" for protecting the ceramic elements from tensile forces which are generally detrimental to the ceramic elements. The absence of mechanical bias provides a transducer having a tube which is not overly stiffened by the electromechanical driver. Therefore, the transducer can be driven harder such that acoustic signals of greater amplitude are provided. Further, unlike magnetic elements which generally maintain their magnetic characteristics above 400° F., piezoelectric ceramics generally lose their piezoelectric characteristics through depolarization at temperatures above approximately 180° F. This precludes their use in high temperature environments such as in oil logging or oil exploration applications.

Figure 4:
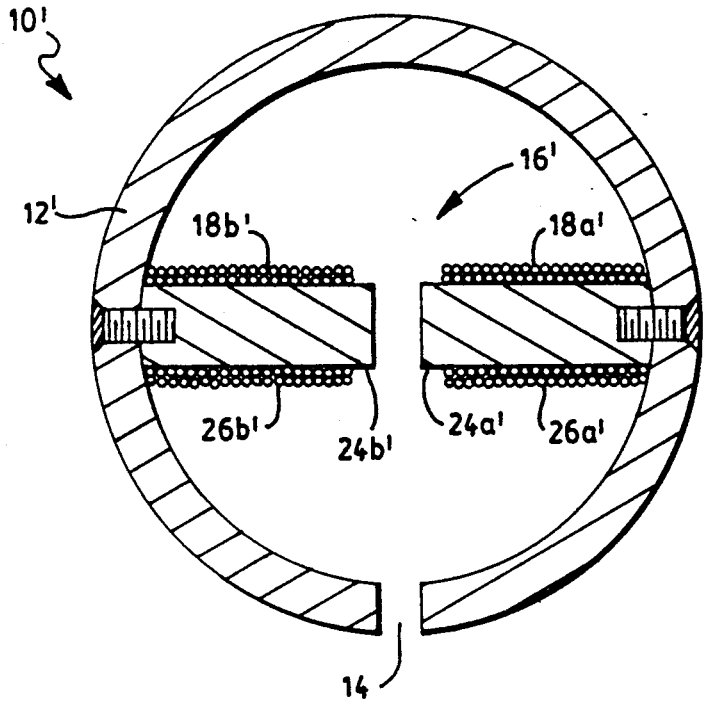
FIG. 4 is a cross-sectional view of a split-ring cylindrical transducer having an alternative embodiment of a magnetically driven electromechanical driver.

Referring now to FIG. 4, another embodiment of a flexural transducer 10, is shown to include a hollow tube 12 having an electromechanical driver assembly 16' disposed within the tube in the same manner as was described in relation to flexural transducer 10 above. The electromechanical driver assembly 16' includes a pair of electromagnet assemblies **18*a'*, 18*b'* as was described in the preferred embodiment above, the electromagnet assemblies 18*a'*, 18*b'* each include a core 24*a'*, 24*b'* fabricated with a highly permeable material such as soft iron or steel and a solenoid 26*a'*, 26*b'* having an insulated conductor wound around respective cores 24*a'*, 24*b'*. Each of the solenoids 26*a'*, 26*b'*** have terminals for allowing the application of electric current from independent external power sources (not shown).

The transducer 10', having the pair of electromagnet assemblies **18*a'*, 18*b'* operates similarly to the aforementioned flexural transducer 10 having the permanent magnet 20. However, in this preferred embodiment, each of the electromagnet assemblies 18*a'*, 18*b'* are independently attracted and repulsed during both half cycles of the applied alternating current. In this way, the inner portions of the tube 12' are attracted and repulsed to provide increased expansion and contraction to the inner portions of the tube 12'. A flexural transducer is thereby provided which has a larger output acoustic power signal but which operates at twice the frequency of the embodiment of flexural transducer 10** described above.

Figure 5:
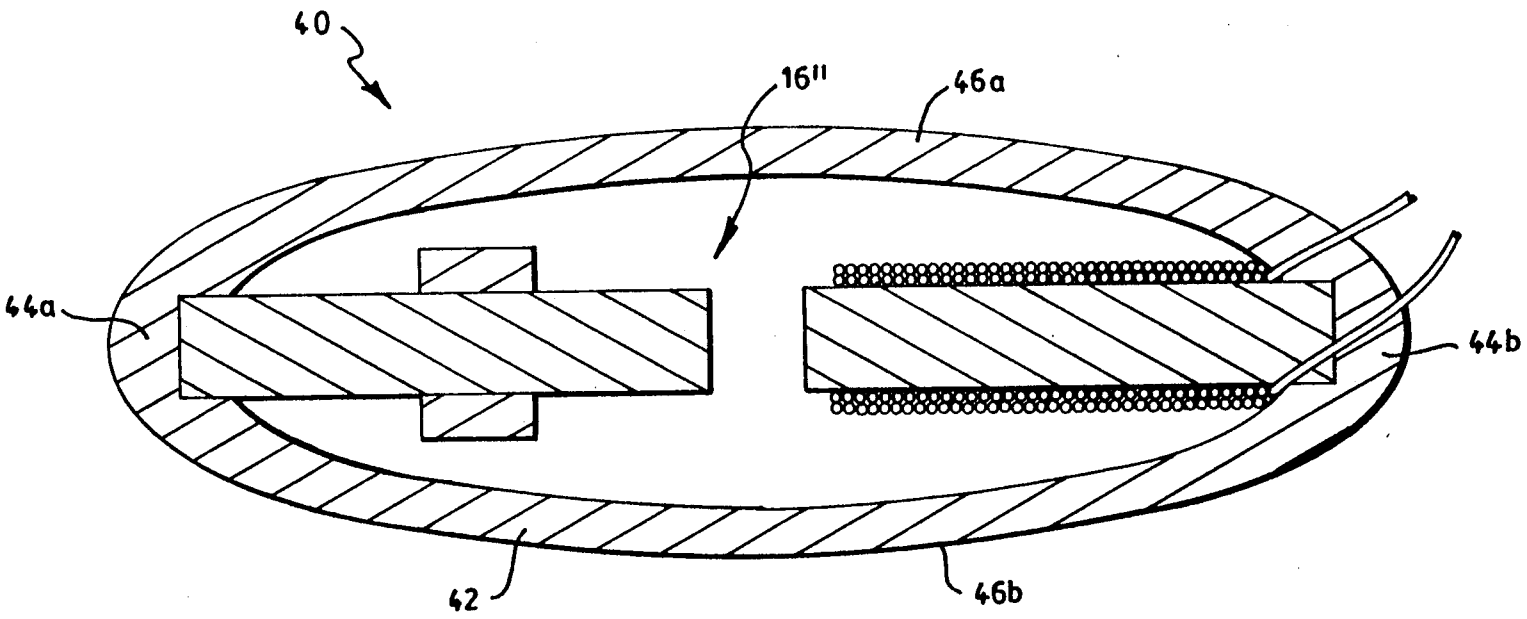
FIG. 5 is a cross-sectional view of a flextensional transducer having a magnetically driven electromechanical driver.

Referring now to FIG. 5, a flextensional transducer 40 is shown to include an electromechanical driver assembly 16'', as described above, disposed within an oval or elliptical shell 42. The shell 42 has end portions **44*a*, 44*b* and flexing portions 46*a*, 46*b*** disposed at the major and minor diameters, respectively.

The electromechanical assembly 16'', in response to an alternating current, is dynamically excited such that the driver longitudinally expands and contracts. During a first half cycle, longitudinal expansion of the electromechanical driver 16'' causes the elliptical shell 42 to move outward at end portions **44*a*, 44*b* and flexinq portions 46*a*, 46*b* to move inward. The shell 42, during this first half cycle, produces a rarefaction of the medium surrounding the transducer 40. Conversely, during the second half cycle, the end portions 44*a*, 44*b* move inward and flexing portions 46*a*, 46*b*** move outward. In this way, the transducer provides a compressive force upon the medium surrounding the transducer and provides an acoustic wave for propagation into the medium.

Figure 6:
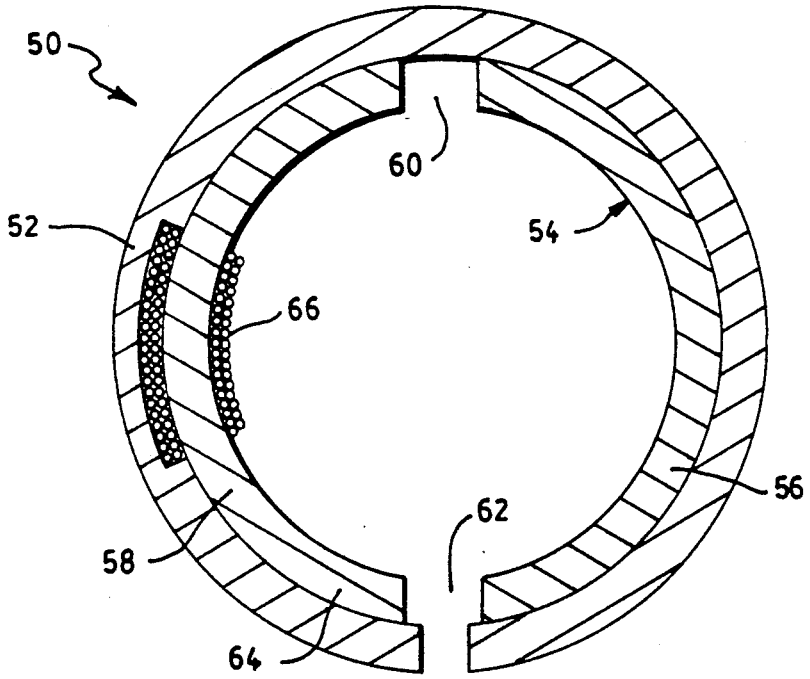
FIG. 6 is a cross-sectional view of a split-ring cylindrical transducer having an alternative embodiment of a magnetically driven electromechanical driver.

Referring now to FIG. 6, a further alternate embodiment of a flexural transducer 50 is shown to include a hollow tube 52 having an electromechanical driver assembly 54 disposed within the tube. The electromechanical driver 54 includes a permanent magnet 56 having a semicircular shape conforming to and disposed along the inner surface of the tube 52. The driver further includes a similarly shaped electromagnet assembly 58 disposed along an opposite inner surface of the tube 52, such that end portions of the permanent magnet 56 and electromagnet assembly 58 are in opposition and separated by a pair of air gaps 60, 62.

The permanent magnet is fabricated from any highly magnetic materials known by those of ordinary skill in the art. The electromagnet assembly 58 includes a core 64 and a solenoid 66 having an insulated conductor wound about the core 64 in the form of a helix. The core may be fabricated from any highly permeable materials such as those mentioned in conjunction with the core 24 of FIGS. 1-3.

The permanent magnet 54 has a magnetic field with portions of the field provided to gaps 60, 62. The polarity of the fields provided to each of the gaps by the permanent magnet 54 are fixed and opposite with respect to each other. The electromagnet assembly 58 in response to an alternating current applied to the solenoid 66 generates a magnetic field within the core 64 which has direction that corresponds to the phase of the applied electrical current.

During a first half cycle of operation, opposing end portions of the electromagnet assembly 58 and permanent magnet 54 have magnetic polarities, which are attracted to each other. The tube 52, in response, contracts inward rarefying the medium in which the transducer 50 is disposed. During a second half cycle, the opposing end portions are repelled such that the tube 52 expands outward to compress the medium. In this way, expansion and contraction of the tube 52 provides generation of acoustic signals from the transducer 50 to the medium in which the transducer is disposed.

Having described preferred embodiments of the invention, it will be apparent to one of skill in the art that other embodiments incorporating its concept may be used. It is believed, therefore, that this invention should not be restricted to the disclosed embodiment but rather should be limited only by the spirit and scope of the appended claims.

What is claimed is:

1. A transducer comprising:

a hollow shell having a gap along a length of the shell and an inner surface;

an electromagnet, disposed within said hollow shell and adjacent a first portion of said inner surface and having a pair of end portions corresponding to pole pieces of the electromagnet to provide a magnetic field;

means, disposed within said hollow shell, for providing a magnet to provide a magnetic field, said means having first and second end portions corresponding to first and second pole pieces of said providing magnet means, wherein at least one of said first and second pole pieces of said electromagnet is disposed opposite a corresponding one of said first and second pole pieces of said providing magnet means to provide a gap between said electromagnet and said providing magnet means, the gap between the electromagnet and the providing magnet means disposed aligned with the gap of the hollow shell; and means, disposed within said hollow shell between said electromagnet and said means for providing a magnet, for providing a return path for the magnetic field generated by said electromagnet and said means for providing a magnet.

2. The transducer, as recited in claim 1, wherein said means for providing a magnet is a permanent magnet.

3. The transducer, as recited in claim 2, wherein said electromagnet comprises:

a) a core comprises of a magnetically permeable material; and b) a winding of insulated wire disposed around said core.

4. The transducer, as recited in claim 3, wherein said core comprises:

a) a plurality of layers of iron laminated together with an adhesive.

5. The transducer as recited in claim 1, wherein said hollow shell is elliptical and has a major and a minor diameter, and said electromechanical driver is disposed along said major diameter of said elliptical hollow shell.

6. The transducer as recited in claim 2, further comprising a member disposed on said permanent magnet, with said permanent magnet and said member, in combination having a weight substantially equal to a weight of said electromagnet.

7. A transducer comprising:

a hollow shell having a gap along a length of the shell and an inner surface;

an electromagnet, disposed within said hollow shell, to provide a magnetic field, said electromagnet having a first end disposed adjacent a first portion of said inner surface and a second end extending towards a second opposing inner portion of said hollow shell;

means, disposed within said hollow shell, for providing a magnet to provide a magnetic field, said means having a first end adjacent to said second opposing portion of said inner surface of said hollow shell and a second end disposed opposite to the second end of said electromagnet and spaced therefrom by a gap, the gap disposed aligned with the gap of the hollow shell; and means, disposed within said hollow shell between said electromagnet and said means for providing a magnet, for providing a return path for the magnetic field generated by said electromagnet and said means for providing a magnet.

8. The transducer, as recited in claim 7, wherein said means for providing a magnet is a permanent magnet.

9. The transducer, as recited in claim 8, wherein said electromagnet comprises:- a) a core comprised of a magnetically permeable material; and b) a winding of insulated wire disposed around said core.

10. A transducer comprising:

a) a hollow tube having an inner surface and a length with a gap extending along said length;

b) an electromagnetical driver comprising: a pair of electromagnets to provide a magnetic field, each one of the pair of electromagnets having a first end coupled to diametrically opposing inner surfaces of said hollow tube and a second end disposed opposing to and in proximity to each other, said pair of electromagnets separated by a gap, said gap between said pair of electromagnets disposed aligned with said gap extending along said length of the hollow tube; and c) means, disposed within said hollow tube between the first ends of said pair of electromagnets, for providing a return path for the magnetic field generated by said pair of electromagnets.

11. The transducer, as recited in claim 10, wherein aid electromagnetic element comprises:

a) a core comprised of a ferromagnetic material; and b) a coil, disposed around said core, comprising a winding of insulated wire.

12. The transducer, as recited in claim 11, wherein said core comprises:

a) a plurality of layers of iron laminated together with an adhesive.

13. The transducer as recited in claim 10, wherein said hollow tube is elliptical and has a major and minor diameter, said said electromechanical driver is disposed along said major diameter of said elliptical hollow tube.

14. The transducer recited in claim 1 wherein said means for providing a return path comprises a plurality of high permeability layers.

15. The transducer recited in claim 14 wherein said high permeability layers are comprised of iron.

16. The transducer recited in claim 7 wherein said means for providing a return path comprises a plurality of high permeability layers.

17. The transducer recited in claim 16 wherein said high permeability layers are comprises of iron.

* * * * *